US006625991B1

(12) United States Patent
Clark

(10) Patent No.: US 6,625,991 B1
(45) Date of Patent: Sep. 30, 2003

(54) SPACE SAVING FOOD CHILLER

(75) Inventor: George A. Clark, Lewis Center, OH (US)

(73) Assignee: Delta T, LLC, Racine, WI (US)

( * ) Notice: Subject to any disclaimer, the term of this patent is extended or adjusted under 35 U.S.C. 154(b) by 0 days.

(21) Appl. No.: 10/192,114

(22) Filed: Jul. 10, 2002

(51) Int. Cl.[7] ..... F25B 2/02
(52) U.S. Cl. ..... 62/3.6; 62/371; 62/457.9
(58) Field of Search ..... 62/316, 312, 313, 62/317, 371, 457.9

(56) References Cited

U.S. PATENT DOCUMENTS

| | | | |
|---|---|---|---|
| 2,446,686 | A | 8/1948 | Behrens |
| 2,915,884 | A | 12/1959 | Haushalter et al. |
| 3,040,539 | A | 6/1962 | Gaugler |
| 3,823,567 | A | 7/1974 | Corini |
| 3,986,337 | A | 10/1976 | Richard |
| 4,297,850 | A | 11/1981 | Reed |
| 4,326,383 | A | 4/1982 | Reed et al. |
| 4,472,945 | A | 9/1984 | Cech et al. |
| 4,726,193 | A | 2/1988 | Burke et al. |
| 4,823,554 | A | 4/1989 | Trachtenberg et al. |
| 4,845,958 | A | 7/1989 | Senda et al. |
| 5,042,258 | A | 8/1991 | Sundhar |
| 5,111,664 | A | 5/1992 | Yang |
| 5,209,069 | A | 5/1993 | Newnan |
| 5,247,798 | A | 9/1993 | Collard, Jr. |
| 5,315,830 | A | 5/1994 | Doke et al. |
| 5,423,194 | A | 6/1995 | Senecal |
| 5,431,021 | A | 7/1995 | Gwilliam et al. |
| 5,456,164 | A | 10/1995 | Bang |
| 5,598,713 | A | 2/1997 | Bartilucci |
| 5,661,979 | A | 9/1997 | DeBoer |
| 5,699,669 | A | 12/1997 | Gebhard |
| 5,718,124 | A | 2/1998 | Senecal |
| 5,771,709 | A | 6/1998 | Smith |
| 5,782,094 | A | 7/1998 | Freeman |
| 5,813,233 | A | 9/1998 | Okuda et al. |
| 6,226,994 | B1 | 5/2001 | Yamada et al. |
| 6,295,820 | B1 | 10/2001 | Cauchy et al. |
| 6,308,519 | B1 | 10/2001 | Bielinski |
| 6,351,951 | B1 | 3/2002 | Guo et al. |
| 6,385,976 | B1 | 5/2002 | Yamamura et al. |

OTHER PUBLICATIONS

US 6,381,965, 5/2002, Ghoshal (withdrawn)

*Primary Examiner*—Melvin Jones
(74) *Attorney, Agent, or Firm*—Andrus, Sceales, Starke & Sawall

(57) ABSTRACT

A spaced saving fruit chiller is adapted to be mounted under a covered or horizontal surface or placed in a corner on a counter. The interior of the container is cooled by a forced air flow utilizing a Peltier thermoelectric device, one wall of the container forming a wall of the air flow duct system and containing both the air inlet holes to the container and the air outlet holes from the container into the duct system.

12 Claims, 15 Drawing Sheets

SPACE SAVING FOOD CHILLER

BACKGROUND OF THE INVENTION

The present invention relates to a device for chilling fresh fruit and other fresh food products and, more particularly, to an improved under-counter fruit chiller utilizing a Peltier effect thermoelectric device.

Thermoelectric devices operating in accordance with the well know Peltier effect have been used as cooling/heating devices for many years. Such a thermoelectric device comprises an array of semiconductor couples connected electrically in series and thermally in parallel. The semiconductor couples are sandwiched between metalized ceramic substrates. When DC electric current is applied in series to the thermoelectric device, it acts as a heat pump with heat being absorbed on the cold side, thereby cooling it, while heat is dissipated at the other side. Reversing the current causes the direction of heat flow to be reversed. Attaching a heat sink and a cold sink to the respective hot and cold sides may enhance the efficiency of the thermoelectric device.

Peltier effect devices have long been used to provide coolers and/or heaters for keeping foods fresh or for warming foods for serving. It has also been found and is well known to use forced-air convection to aid in heat transfer. A small electric fan is typically used to circulate air past the cold sink and into and through a container for the food, while another fan moves ambient outside air across the heat sink to dissipate heat from it.

Although chillers for fresh fruit and other perishable food products are well known in the art, the market success of such devices has been limited. There appear to be a number of reasons for this lack of market success. One is the cost and heat transfer efficiency of the solid state thermoelectric modules. In addition, the need to provide circulation of cool air to attain the greatest cooling efficiency has led to complex duct systems which add substantially to the cost of the containers, typically made of molded plastic materials. A long air circulation duct system also results in heat loss and pressure drop, both of which decrease the efficiency or add to the product cost. Another issue with prior fruit chillers is the utilization of counter space. Limited counter space availability in current homes can restrict the purchase of additional counter top appliances. The fruit chiller of the current invention utilizes kitchen space otherwise underutilized.

SUMMARY OF THE INVENTION

In accordance with the present invention, a chiller for fresh fruit or other perishable food products utilizes a construction which optimizes a cooling air flow and thus heat transfer efficiency with a container construction that is less expensive to manufacture and permitting the use of a relatively smaller thermoelectric module. Thermoelectric modules of increased efficiency, such as disclosed in U.S. Pat. No. 5,448,109, are particularly suitable for use in the fruit chiller of the subject invention.

In one overall embodiment, the food chiller of the present invention is mounted under a cabinet or other overhanging horizontal surface and comprises a housing for mounting a Peltier effect thermoelectric module sandwiched between a cold sink and an opposite heat sink. The housing also defines a downward facing duct system that includes a cool air supply duct in heat transfer communication with the cold sink, a return air duct, and a cool air circulation fan in the cooling duct system to circulate air therethrough.

A food container portion is adjacent the housing and contains enclosing sidewalls and is openable from the housing for retrieval of the food. The food container portion has therein a plurality of inlet and outlet holes in a wall that completes the duct system.

In one embodiment the food container is slidably attached to the housing. Sliding the food container relative to the housing allows access to the food contained therein.

In another embodiment the food container is pivotally mounted to the housing. Pivoting the food container away from the housing allows access to the food contained therein.

In another overall embodiment, the food chiller of the present invention is located on a counter surface in the corner of two intersecting walls and comprises a housing for mounting a Peltier effect thermoelectric module sandwiched between a cold sink and an opposite heat sink. The housing also defines a lateral facing duct system that includes a cool air supply duct in heat transfer communication with the cold sink, a return air duct, and a cool air circulation fan in the cooling duct system to circulate air therethrough.

A food container portion is adjacent the housing and contains enclosing sidewalls and is openable from the housing for retrieval of the food. The food container portion has therein a plurality of inlet and outlet holes in a wall that completes the duct system.

The food container portion is normally such that cooling air is continuously recirculated. In one embodiment, however, an outside ambient air supply conduit communicates with the cooling duct system and includes a metering device to admit a controlled flow of outside air to assist in purging the cooling duct system of ethylene gas and other ripening by-products of fruit. The metering device may comprise a small diameter tube connected to the duct system upstream of the fan.

To help maintain the interior temperature of the container, a removable insulating sleeve may be inserted into the container. The sleeve is shaped to conform to the interior of the enclosing sidewall. The removable cover may also be provided with an insulating liner.

Various arrangements of partitions may be placed within the container to divide the container into different temperature zones by varying the flow of cooling air through the zones. Such partitions may be vertically disposed to extend upwardly from the container bottom wall or may be horizontally disposed and attached, for example, to a central tower or to the container sidewall.

DETAILED DESCRIPTION OF THE PREFERRED EMBODIMENT

Figure 1:
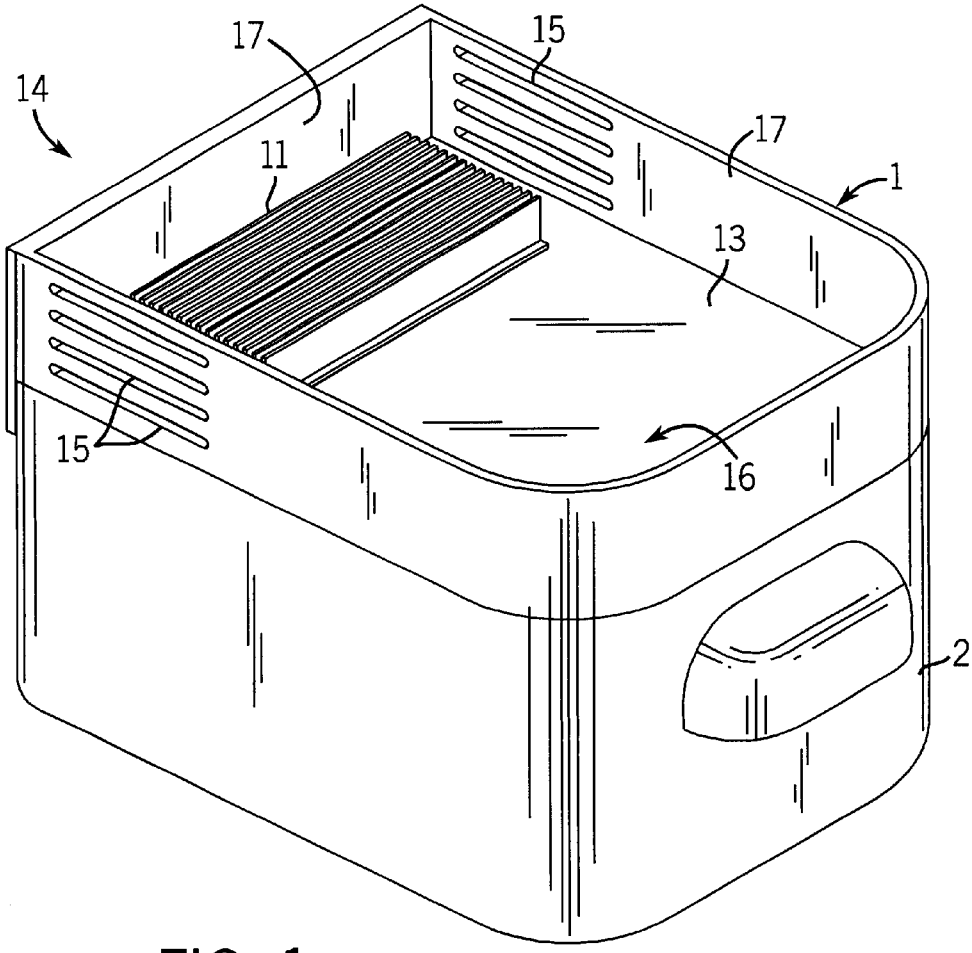
FIG. 1 is a perspective view showing the general arrangement of the under-counter fruit chiller of the subject invention.
Figure 2:
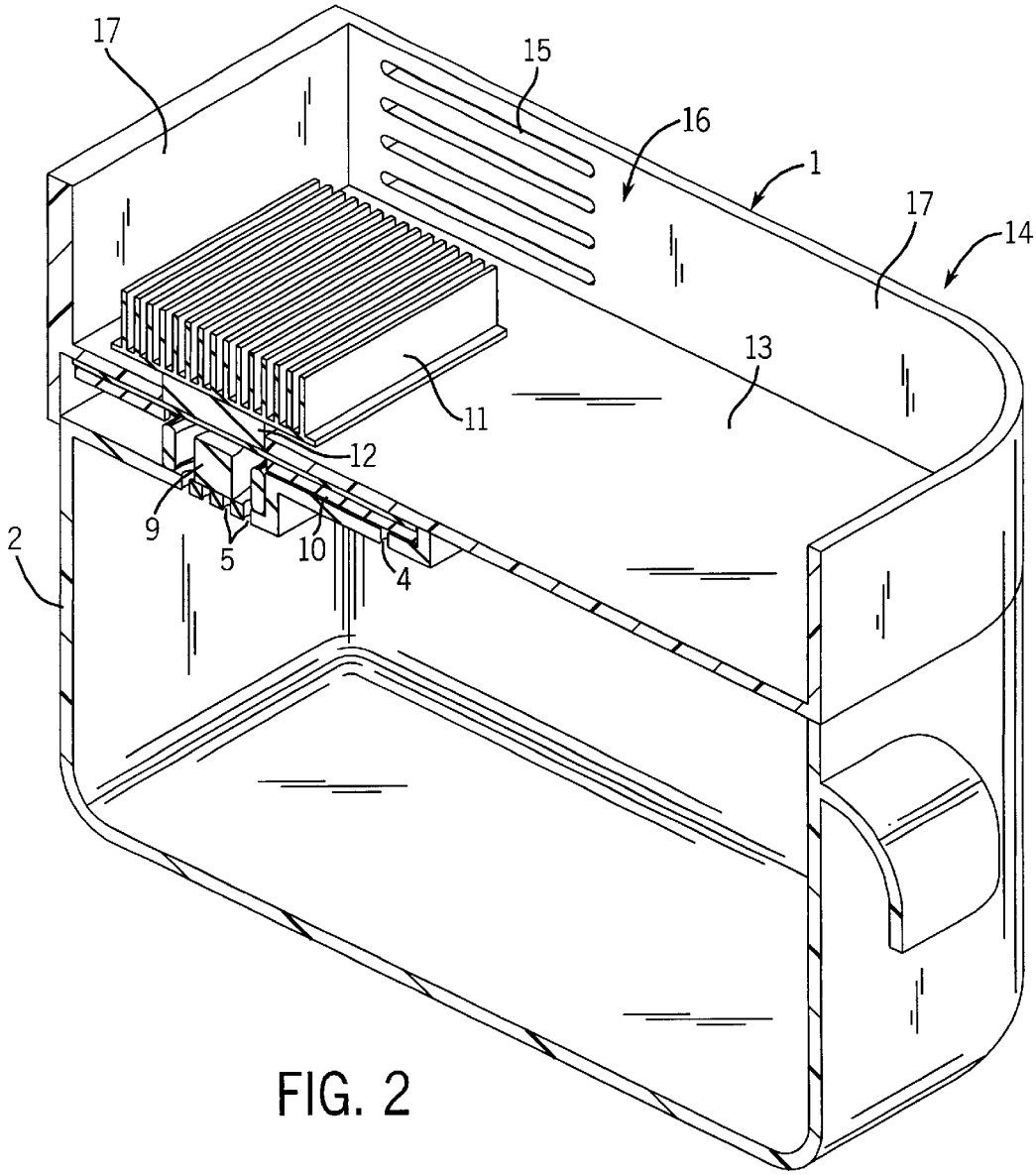
FIG. 2 is a perspective view of the fruit chiller of FIG. 1 cut vertically in half for viewing of the interior components.
Figure 3:
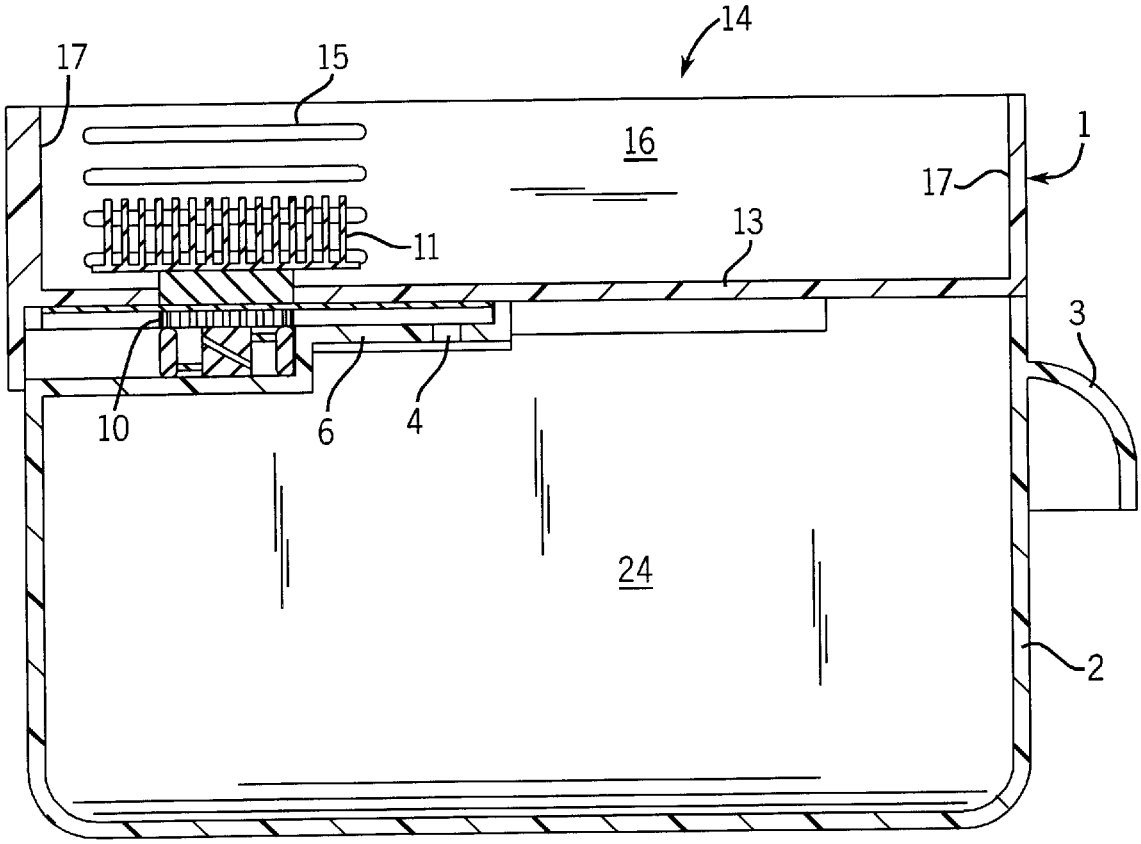
FIG. 3 is a vertical section through the fruit chiller shown in FIG. 1.
Figure 4:
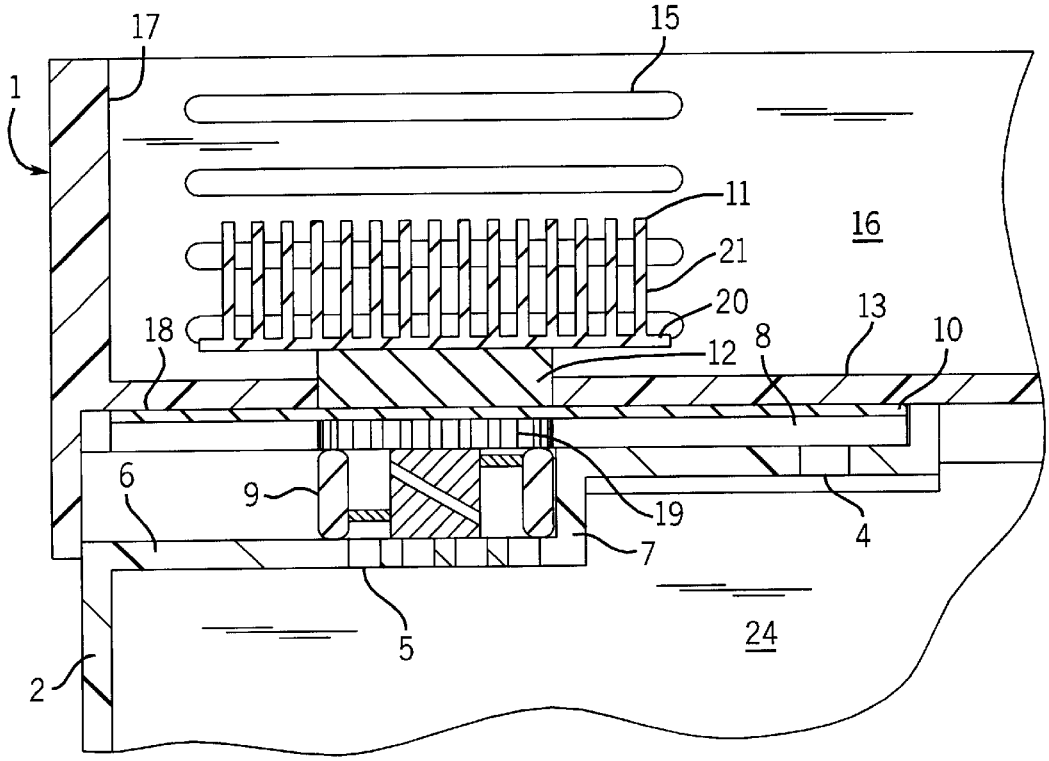
FIG. 4 is a detailed view of the section of FIG. 3.
Figure 5:
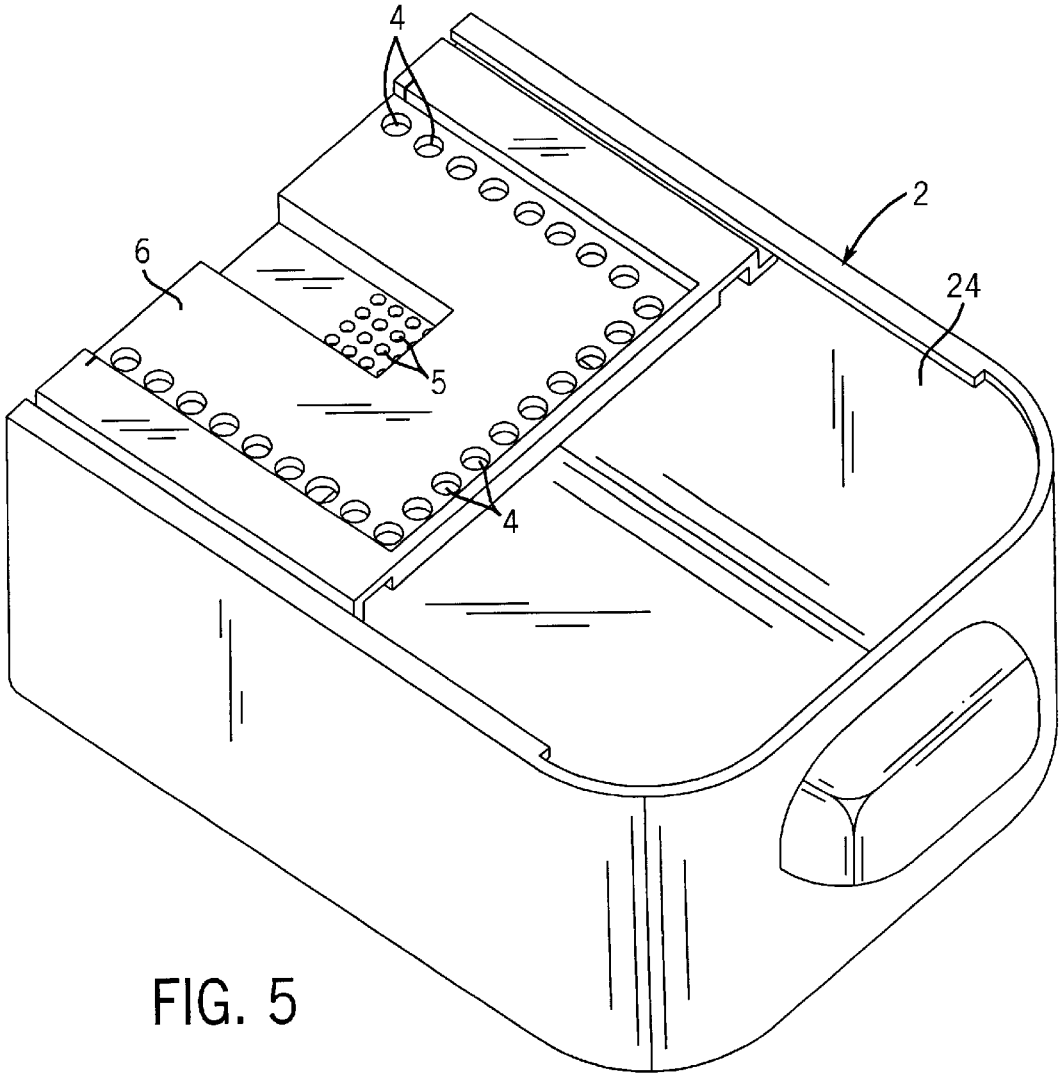
FIG. 5 is a perspective view of the food container portion of the fruit chiller of FIG. 1.
Figure 6:
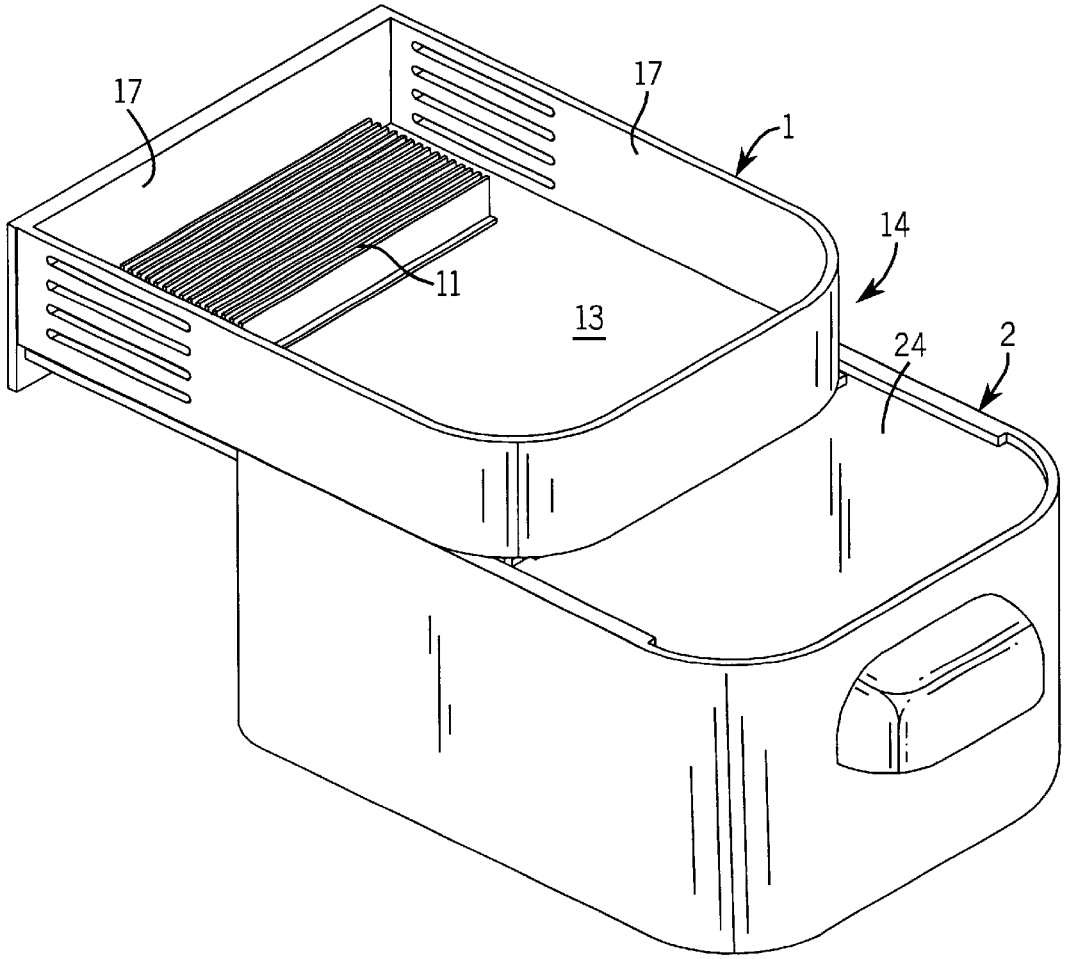
FIG. 6 is a perspective view of the fruit chiller of FIG. 1 with the food container portion opened for access to the food/fruit.

In FIG. 1, there is shown a fruit chiller 14 in accordance with one embodiment of the present invention. The fruit chiller includes a housing 1 for mounting under a horizontal surface, such as a kitchen cupboard. There is space inside housing 1 for housing various components of the cooling system, which will be described in detail herein. A removable container 2 is adjacent the housing 1. Access to the stored food is provided by sliding open the food container portion 2 as shown in FIG. 6. Alternately food container 2 could be pivotally mounted to housing 1. Referring to FIGS. 2 through 4, there are a plurality of holes 4 in container 2 for distributed flow of the cold air into the container. Holes 5 provide a return path for outlet of the air from the container. Upon passing through holes 5, the air is again cooled and recirculated through holes 4. Holes 4 and 5 are in upper wall 6 of food container 2 and are shown in FIG. 5. While this is a preferred embodiment it is also possible to reverse the airflow thus using holes 5 as inlet ports to the container and holes 4 as return air ports. The housing 1 and container 2 may both be made of injection molded plastic materials. The housing 1 is preferably opaque and the container 2 transparent.

The housing 1 defines an ambient air chamber 16 defined generally by housing side walls 17, housing baffle plate 13 and the underside of the cabinet or cupboard surface that the housing is mounted to. Slots 15 provide openings for entry of ambient cooling air into and out of chamber 16.

The container 2 and the food products contained therein are cooled with thermoelectric module 12 utilizing the well-known Peltier effect. The thermoelectric module 12 is mounted in the base baffle plate 13 and positioned generally horizontally in the plane of baffle plate 13. By applying a DC current to the module, heat will be absorbed at one face (in this case the lower side of 12), thereby cooling it. Heat will be dissipated at the other face of the module (in this case the upper side of 12), thereby heating it. As is also well known in the prior art, a cold sink 10 is attached to the lower face and a heat sink 11 is attached to the upper face of the module. The cold sink 10 is typically made of aluminum and includes a flat base 18 and a series of closely spaced fins 19. Similarly, the heat sink 11 includes an aluminum base 20 and integral closely spaced fins 21. The heat rejected by the operating thermoelectric module 12 at the heat sink 11 is dissipated by a flow of ambient air through the ambient air chamber 16.

The space 8 between baffle plate 13 and the food container wall 6 contains cold sink 10 and constitutes a downward facing duct system that is in fluid communication with the container interior 24 via air inlet holes 4 and air outlet holes 5. A fan 9 draws air in through holes 5. As the air is exhausted from the upper portion of fan 9 it passes over cold sink 10, into duct system 8 and reenters the container interior 24 via holes 4. Thus the air within container interior 24 is recirculated and cooled.

Figure 7:
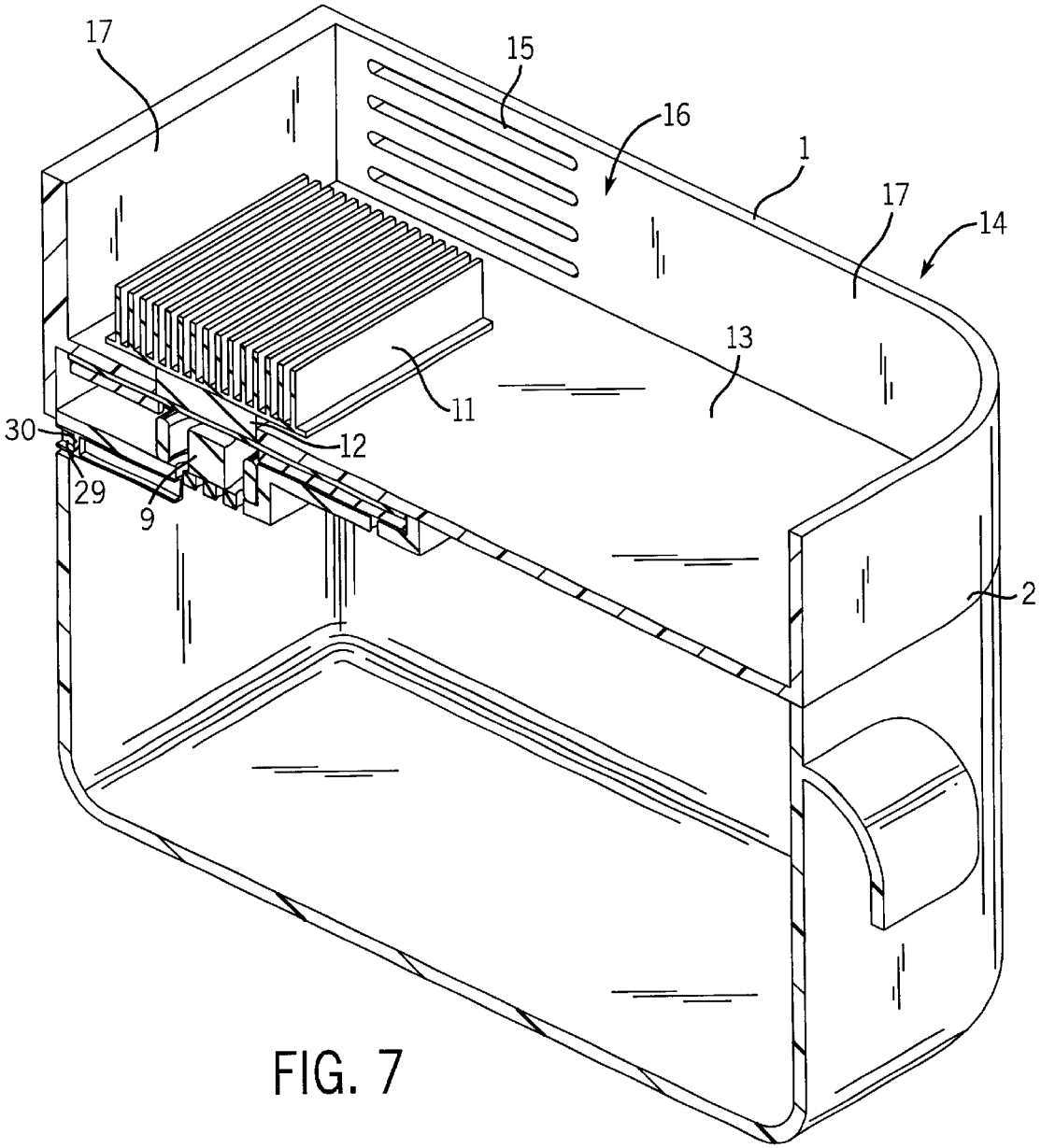
FIG. 7 is a perspective view of an alternate embodiment of the fruit chiller cut vertically in half for viewing of the interior components.
Figure 8:
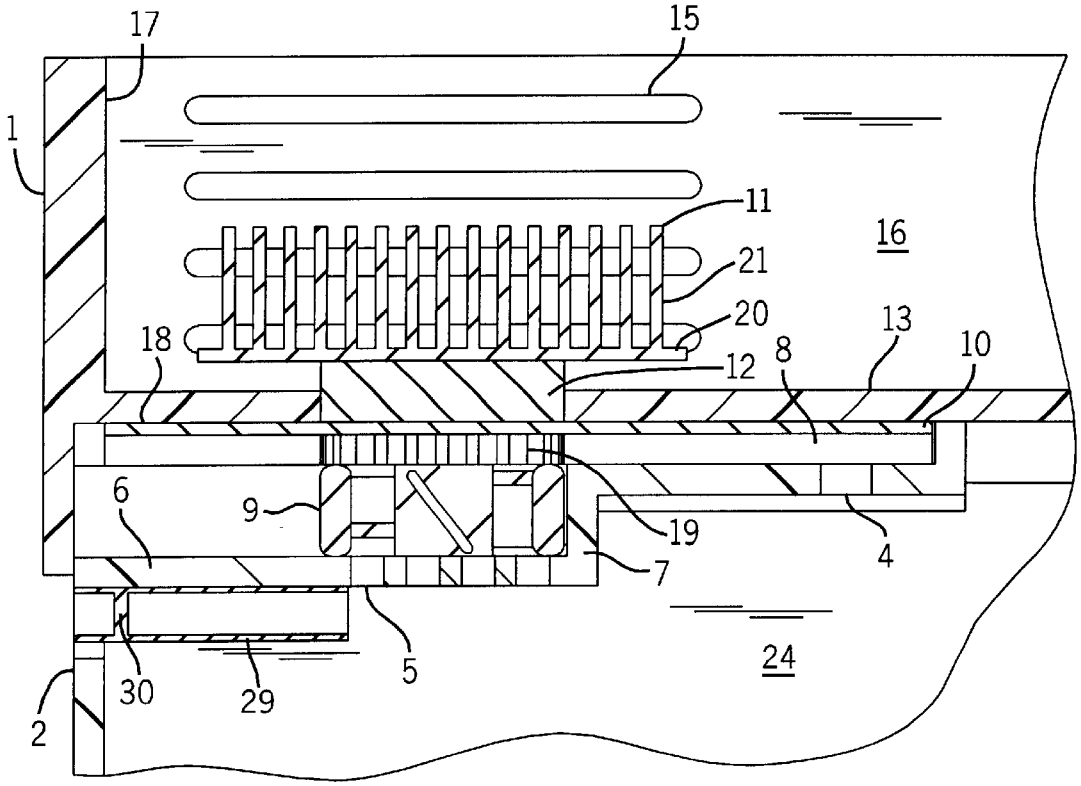
FIG. 8 is a vertical sectional detail of the alternate embodiment of the fruit chiller of FIG. 7.

Ripening fruit is known to emit ethylene gas and other by-products of organic decomposition. It may be desirable to exhaust these gasses by regular or periodic replacement of the cooling air recirculating within the container interior 24. Referring particularly to FIGS. 7 and 8, an ambient air conduit 29 comprising a small diameter metering tube extends through the side wall of the food container into adjacent holes 5 where a small volume flow of ambient outside air is drawn in by the cold sink fan 9 and mixed with the recirculated cooling air. As shown, the ambient air conduit 29 opens adjacent holes 5 just upstream of the inlet to the fan 9. It is believed, however, that the conduit could connect to the duct system at another location therein. The inflow of ambient air may be regulated with the use of an optional valve 30 at the inlet end of the conduit 29. To provide for the corresponding exhaust of ethylene and other gaseous by-products, it is preferred to provide a small leak between the container 2 and the housing 1, however, a manually adjustable vent slot may also be used. The slot could be located in either the wall of the housing 2 or in the housing baffle plate 13.

Figure 9:
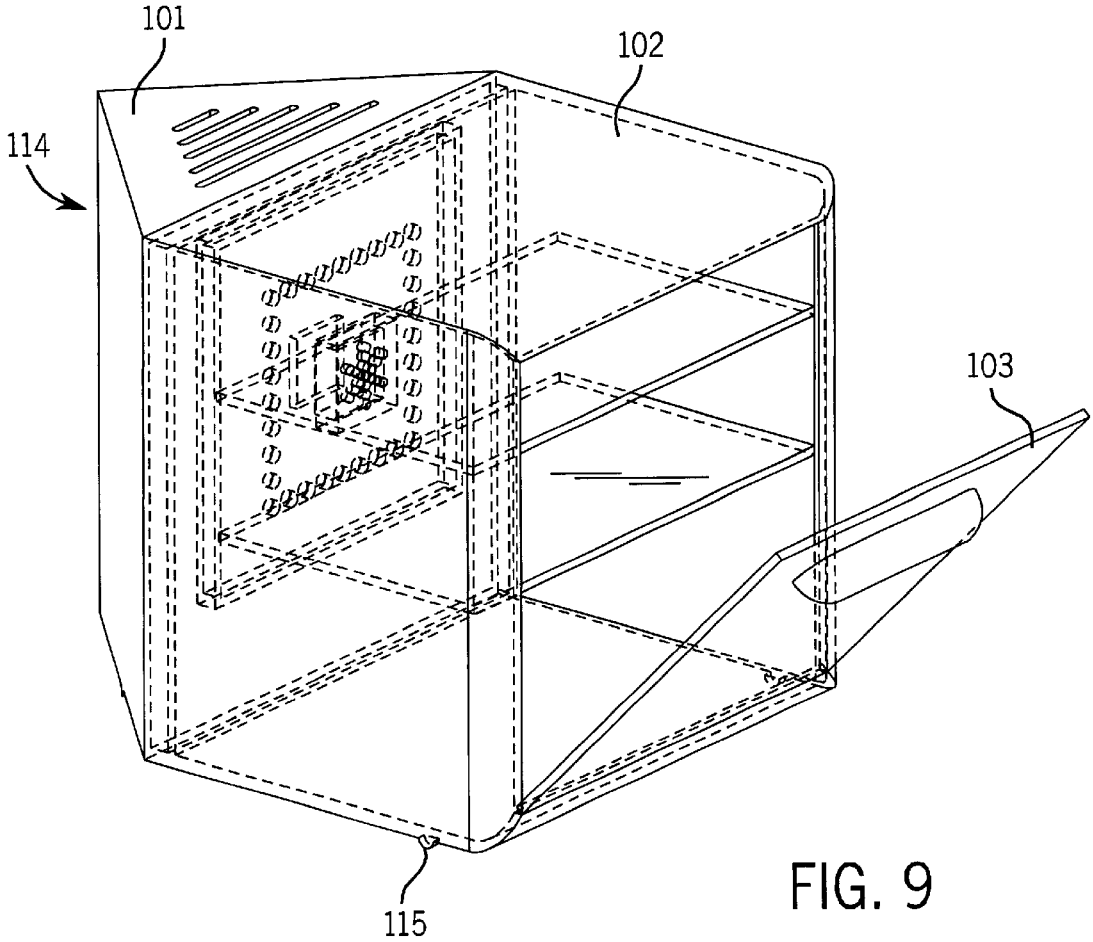
FIG. 9 is a perspective view showing the general arrangement of an on-counter embodiment of the fruit chiller of the subject invention.
Figure 10:
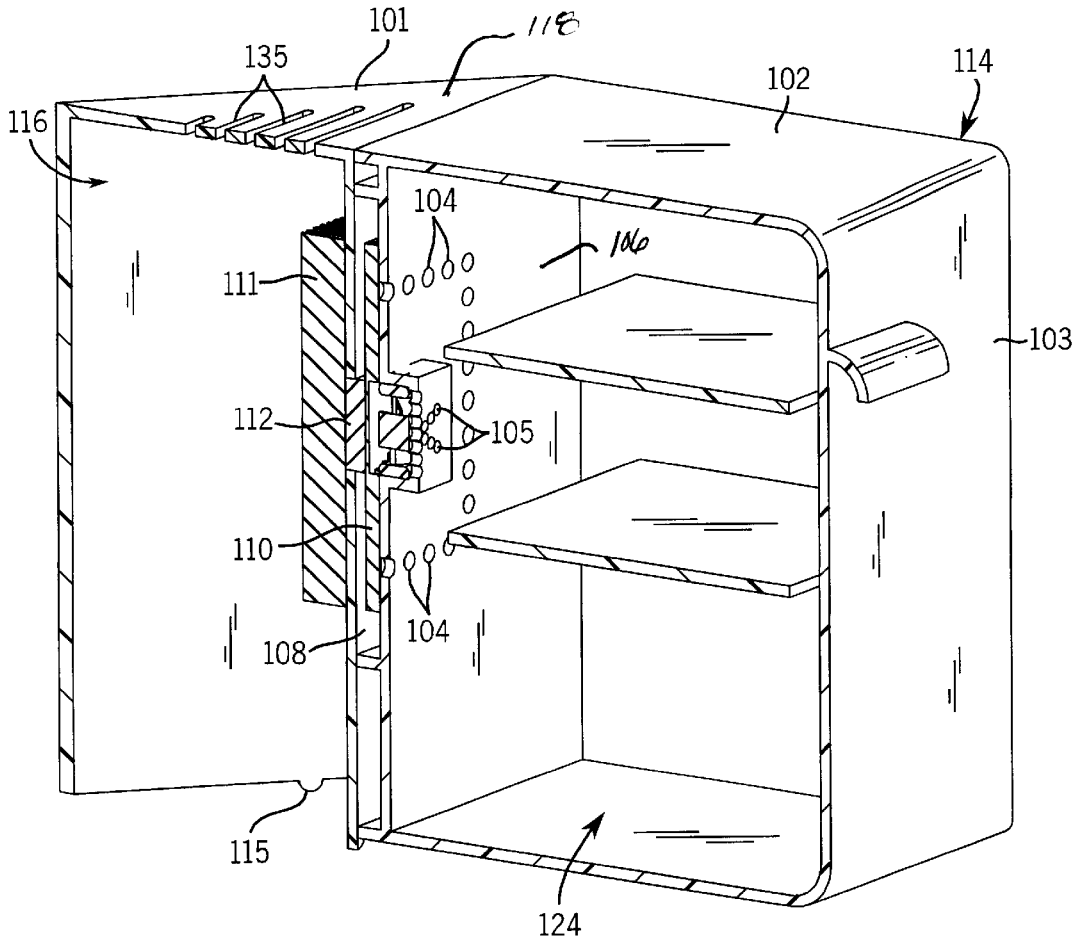
FIG. 10 is an additional perspective view, cut vertically in half showing the general arrangement of the fruit chiller of the subject invention.
Figure 11:
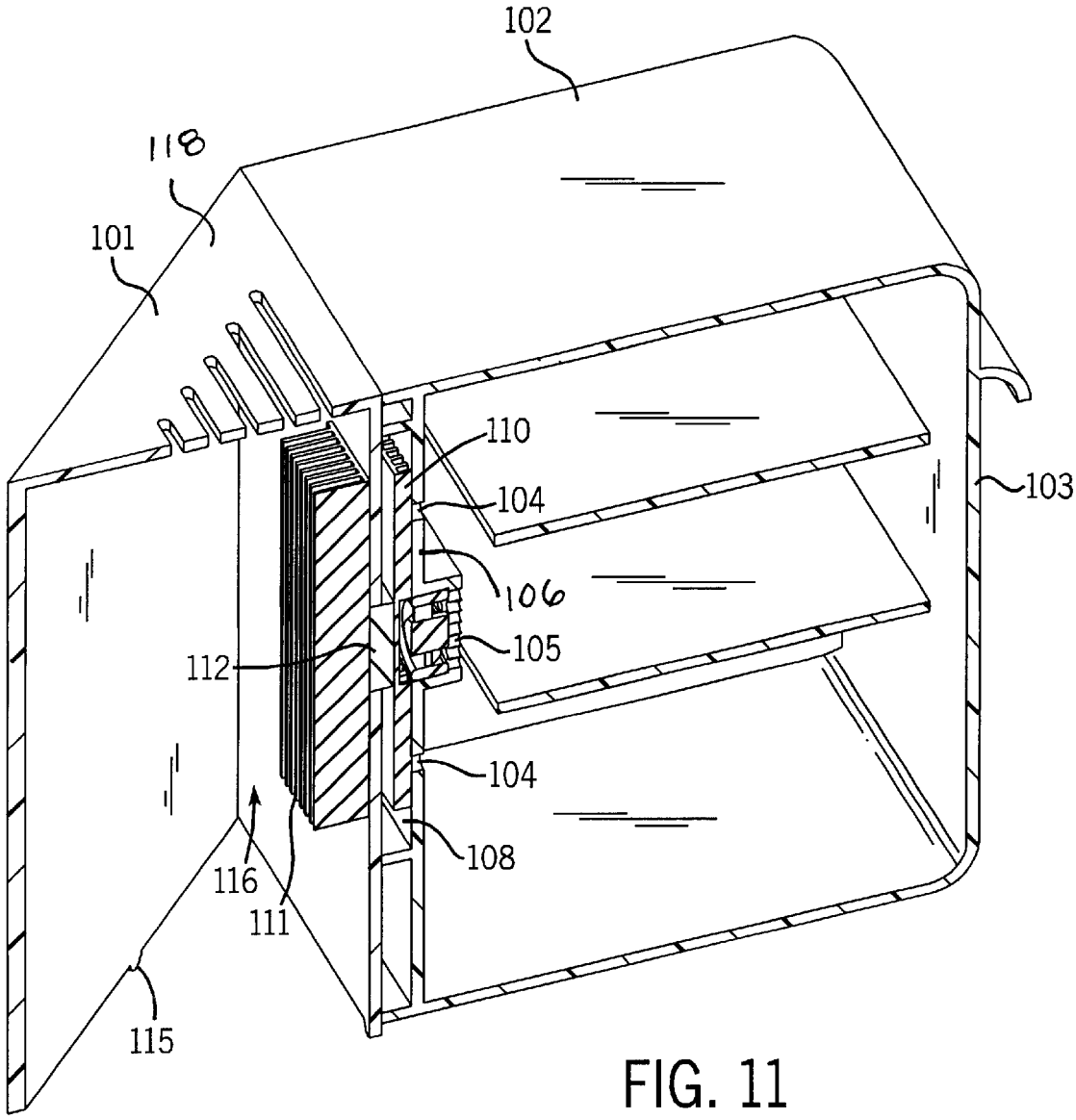
FIG. 11 is a perspective view of the fruit chiller of FIG. 9 cut vertically in half for viewing of the interior components.
Figure 12:
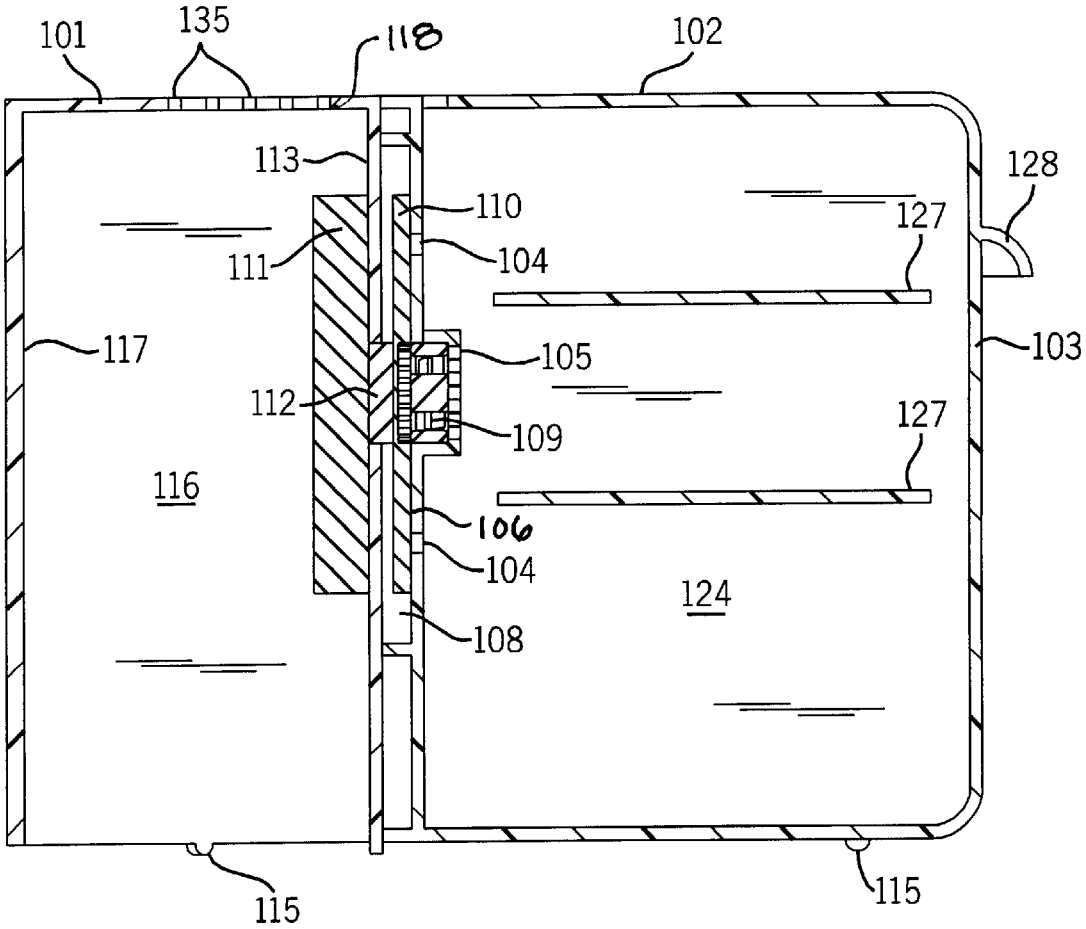
FIG. 12 is a vertical section through the fruit chiller shown in FIG. 10.
Figure 13:
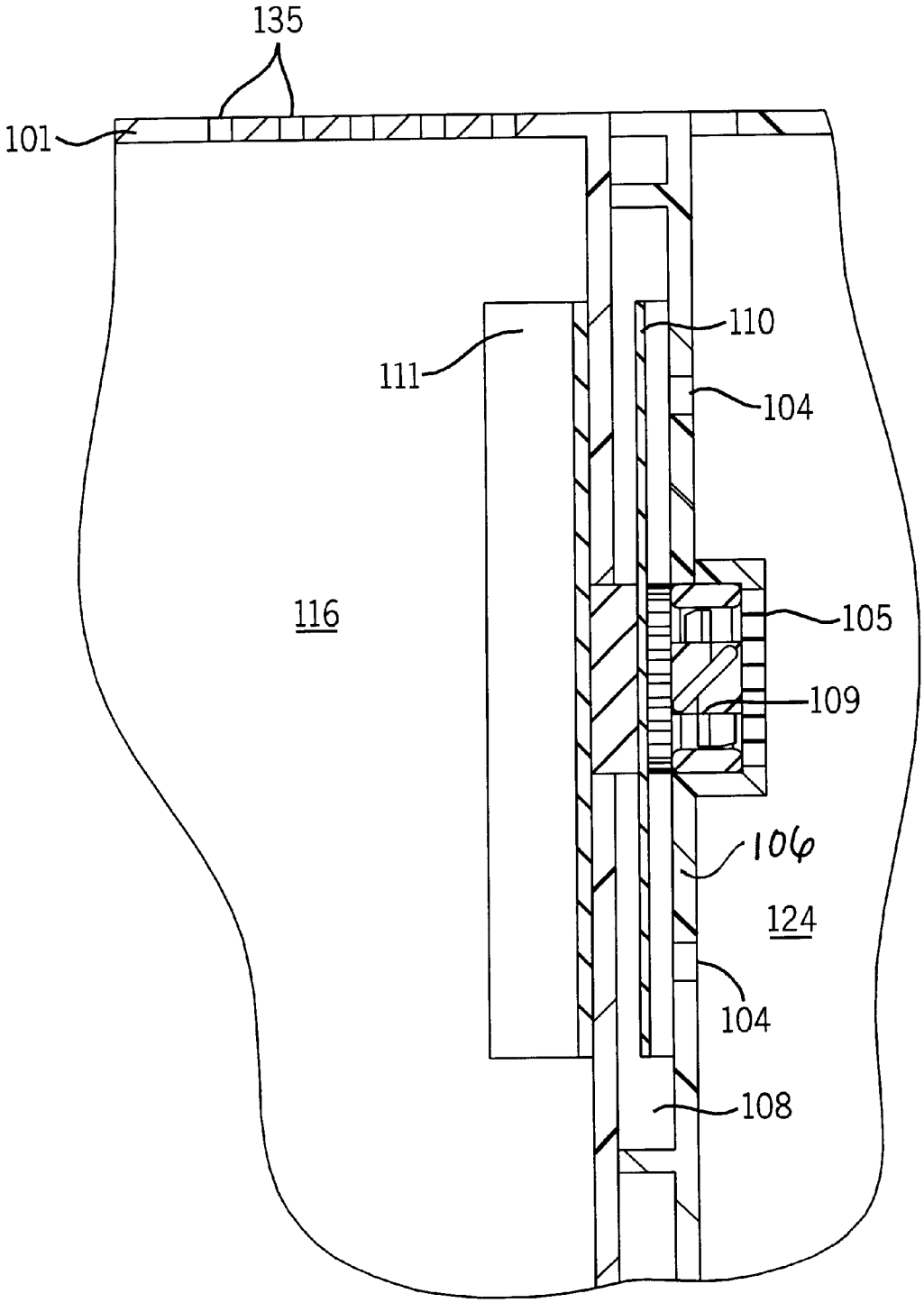
FIG. 13 is a detailed view of the section of FIG. 12.

In FIG. 9, there is shown an alternate form of the fruit chiller 114 in accordance with another embodiment of the present invention. The fruit chiller includes a housing 101 for resting on a counter in the corner of two intersecting walls. There is space inside housing 101 for various components of the cooling system, which will be described in detail herein. A container 102 is adjacent the housing 101. Access to the stored food is provided by opening door 103. Referring to FIGS. 10 through 13, there a plurality of inlet holes 104 in container 102 for distributed flow of the cold air into the container. Holes 105 provide a return path for the air exiting the container. Upon passing through holes 105, the air is again cooled and discharged through holes 104. Holes 104 and 105 are in wall of food container 102 and are shown in FIG. 12 and 13. While this is a preferred embodiment it is also possible to reverse the airflow thus using holes 105 as inlet ports and holes 104 as outlet air ports. The housing 101, container 102 may all be made of injection molded plastic materials. The housing 101 is preferably opaque and the container 102 and door 103 transparent.

The housing 101 defines an ambient air chamber 116 defined generally by housing sidewalls 117, housing top wall 118 and housing baffle plate 113. Feet 115 of housing 101 provide an opening at the. bottom for inlet for ambient cooling air and slots 135 provide exits for the ambient cooling air out of chamber 116.

The container 102 and the food products contained therein are cooled with thermoelectric module 112 utilizing the well-known Peltier effect. The thermoelectric module 112 is mounted in the base baffle 113 and positioned generally vertically in the plane of baffle 113. By applying a DC current to the module, heat will be absorbed at one face, thereby cooling it. Heat will be dissipated at the other face of the module, thereby heating it. As is also well known in the prior art, a heat sink 111 is attached to the hot face and a cold sink 110 is attached to the cold face of the module. The cold sink 110 is typically made of aluminum and includes a flat base and a series of closely spaced fins. Similarly, the heat sink 111 includes an aluminum base and integral closely spaced fins. The heat rejected by the operating thermoelectric module 112 at the heat sink 111 is dissipated by a flow of ambient air through the ambient air chamber 116.

The space 108 between baffle 113 and the food container wall 106 encloses the cold sink 110 and constitutes a laterally facing duct system that is in fluid communication with the container interior 124 via holes 104 holes 105. A fan 109 draws air in through holes 105. As the air is exhausted from fan 109 it passes over cold sink 110, into duct system 108 and reenters the container interior 124 via inlet holes 104. Thus the air within container interior 124 is recirculated and cooled.

Figure 14:
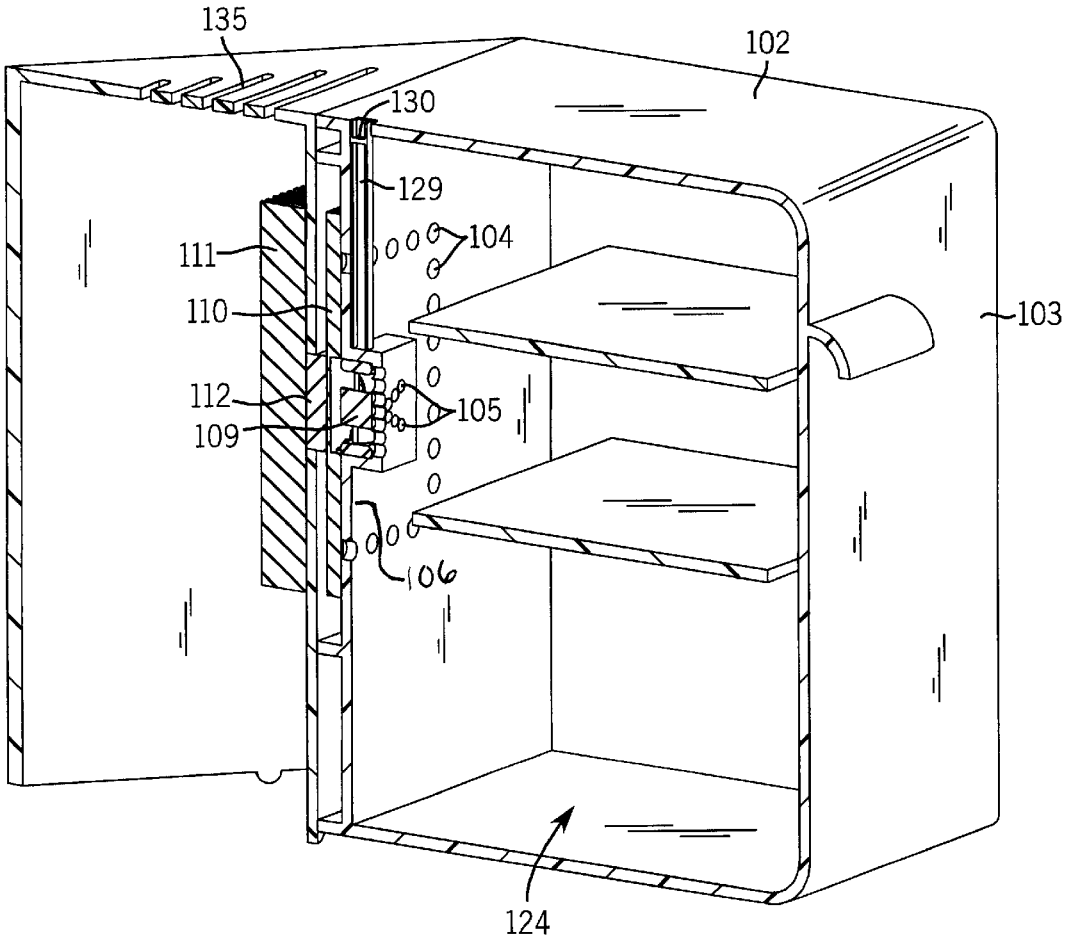
FIG. 14 is a perspective view of an alternate embodiment of the fruit chiller cut vertically in half for viewing of the interior components.
Figure 15:
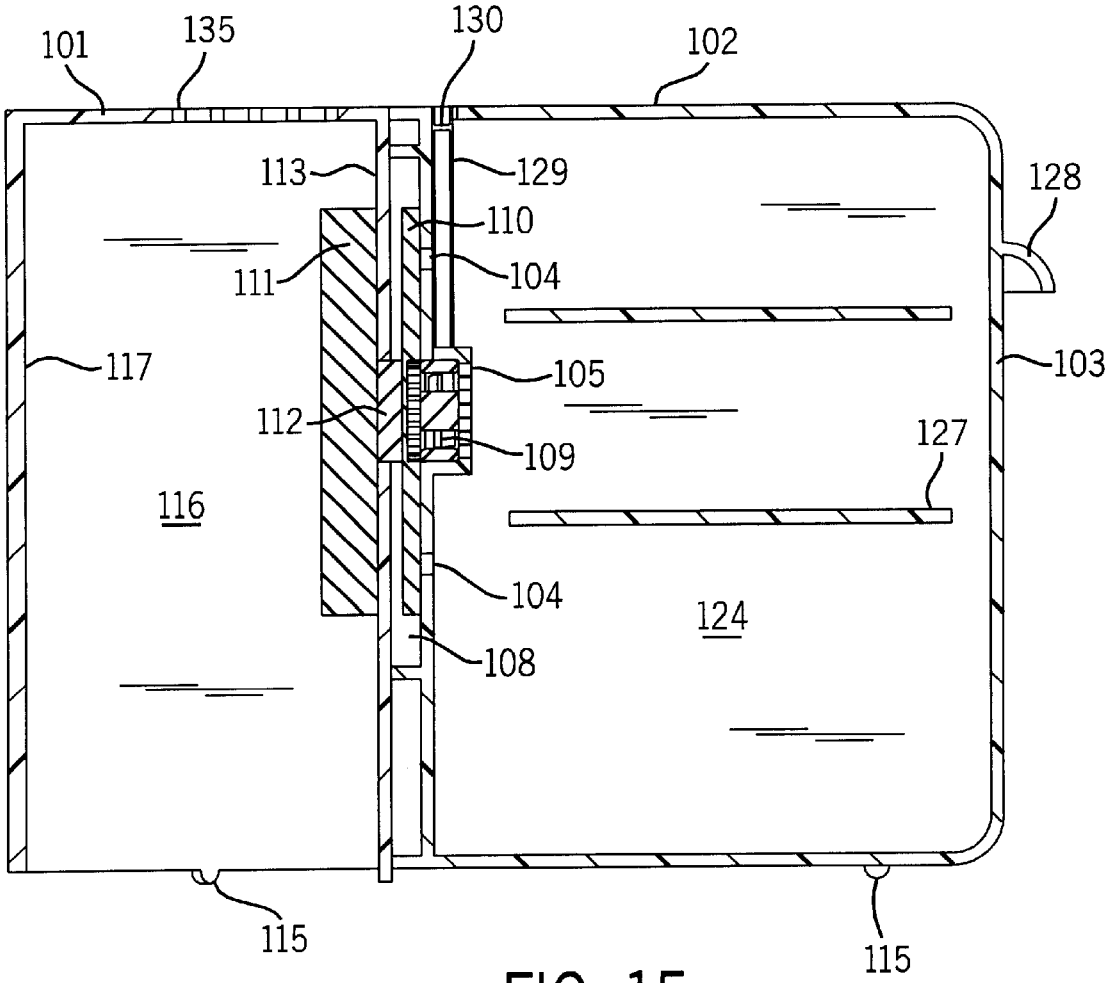
FIG. 15 is a vertical section through the alternate embodiment of the fruit chiller of FIG. 14.

Ripening fruit is known to emit ethylene gas and other by-products of organic decomposition. It may be desirable to exhaust these gasses by regular or periodic replacement of the cooling air recirculating within the container interior 124. Referring particularly to FIGS. 14 and 15, an ambient air conduit 129 comprising a small diameter metering tube extends through the side wall of the food container into adjacent holes 105 where a small volume flow of ambient outside air is drawn in by the cold sink fan 109 and mixed with the recirculated cooling air. As shown, the ambient air conduit 129 opens adjacent holes 105 just upstream of the inlet to the fan 109. It is believed, however, that the conduit could connect to the duct system at another location therein. The inflow of ambient air may be regulated with the use of an optional valve 130 at the inlet end of the conduit 129. To provide for the corresponding exhaust of ethylene and other gaseous by-products, it is preferred to provide a small leak between the container 102 and the door 103.

As indicated previously, the thermoelectric module 12 is normally configured so the outer face is cold while the inner face is hot. Because reversal of the polarity of the supplied current to the thermoelectric module causes the direction of heat flow to be reversed, the fruit chillers of either of the embodiments described herein may also be utilized to warm the fruit to promote or enhance ripening. In this alternate configuration the inner face of the thermoelectric module 12 is hot while the outer face is cold.

Certain fruits may often be purchased in a green or semi-ripe condition. One example is bananas which are often purchased in some semi-ripe condition and allowed to ripen in the open air. By reversal of the supplied current to the thermoelectric module 112, a green or semi-ripe fruit may be ripened more quickly by warming and, when ripe, preserved for a longer time by again reversing the current to provide a cooling air supply to the container 124.

In general, temperature control is an excellent, and by far the best means, of controlling ripening in fruit. As discussed above, warming may be used to enhance and promote ripening of green or semi-ripe fruit, but after the fruit has ripened, cooling is the best means available to slow the biological ripening processes and preserve the fruit for a longer period of time.

The direction of heat transfer of the thermoelectric module 112 can be reversed as mentioned above. The level of heating and cooling can also be controlled by control of the level of supplied current and voltage. In this manner, the user may, for example, select a set point to ripen fruits at a desirable rate or, conversely, a cooling set point to maintain ripened fruit at a temperature found to make the fruit most palatable. Other cooling or warming strategies may also be utilized, either with manual settings by the user or by using programmed microprocessor control.

I claim:

1. A food chiller comprising:

a housing including a horizontal base wall and upwardly extending enclosing side walls;

a Peltier effect thermoelectric device mounted in the base wall and thermally connected to a cold sink on an outer face of the base wall and a hot sink within the housing on an inner face of the base wall;

a food container suspended from the housing and having a wall spaced from and generally parallel to said housing base wall, said container wall and said base wall defining therebetween a downwardly facing duct enclosing the cold sink;

said container wall including downwardly directed air inlet openings into the container and upwardly directed air outlet openings from the container;

a fan mounted at one end of said duct directly between said cold sink and one of said air inlet openings and air outlet openings;

the other of said air inlet openings and air outlet openings defining the other end of said duct; and an ambient air flow path through the housing and across the hot sink defined by ambient inlet and outlet slots in the enclosing side walls.

2. The apparatus as set forth in claim 1 wherein said container is removably attached to the housing.

3. The apparatus as set forth in claim 2 wherein said container is slidably attached to the housing.

4. The apparatus as set forth in claim 1 including a conduit connecting the duct system to ambient outside air.

5. The apparatus as set forth in claim 4 including a valve in said conduit to control the flow of ambient outside air.

6. The apparatus as set forth in claim 1 including control means for said thermoelectric device for controlling the air flow temperature.

7. The apparatus as set forth in claim 6 wherein said control means comprises means for reversing the polarity of the current supplied to the thermoelectric device.

8. The apparatus as set forth in claim 6 wherein said control means comprises means for controlling the magnitude of current and voltage supplied to the thermoelectric device.

9. The apparatus as set forth in claim 1 comprising an exhaust vent from the interior of the container.

10. The apparatus as set forth in claim 9 wherein said vent comprises an adjustable slot in the container wall or in the housing base wall.

11. The apparatus as set forth in claim 1 wherein said housing is adapted to be attached to the underside of a horizontal surface.

12. A food chiller comprising:

a housing defined by a pair of vertical sidewalls joined at an acute angle to fit in a comer of two intersecting walls, said housing also including a vertical base baffle wall and a horizontal upper enclosing top wall;

a Peltier effect thermoelectric device mounted in the base baffle wall and thermally connected to a cold sink on an outer face of the base baffle wall and a hot sink on an inner face of the base baffle wall;

a food container supported on the housing and having a wall spaced from and generally parallel to said housing base wall, said container wall and said base wall defining therebetween a duct enclosing the cold sink;

said container wall including horizontally directed air inlet openings into the container and horizontally directed air outlet openings from the container;

a fan mounted at one end of said duct directly between said cold sink and one of said air inlet openings and air outlet openings;

the other of said air inlet openings and air outlet openings defining the other end of said duct; and, an ambient air flow path through the housing defined by an opening adjacent the lower edges of the sidewalls and slots in the top wall.

* * * * *